US007029343B2

(12) United States Patent
Karlsson

(10) Patent No.: US 7,029,343 B2
(45) Date of Patent: Apr. 18, 2006

(54) STEERING ARRANGEMENT FOR A SHIP PROPELLED BY WATERJET

(75) Inventor: Sven-Gunnar Karlsson, Kristinehamn (SE)

(73) Assignee: Rolls-Royce Aktiebolag, Kristinehamn (SE)

( * ) Notice: Subject to any disclaimer, the term of this patent is extended or adjusted under 35 U.S.C. 154(b) by 0 days.

(21) Appl. No.: 10/510,100

(22) PCT Filed: Apr. 30, 2003

(86) PCT No.: PCT/SE03/00702

§ 371 (c)(1),
(2), (4) Date: Oct. 5, 2004

(87) PCT Pub. No.: WO03/093104

PCT Pub. Date: Nov. 13, 2003

(65) Prior Publication Data

US 2005/0118898 A1 Jun. 2, 2005

(30) Foreign Application Priority Data

Apr. 30, 2003 (SE) ..... 0201293

(51) Int. Cl.
*B63H 11/117* (2006.01)

(52) U.S. Cl. ..... 440/41; 440/43

(58) Field of Classification Search ..... 440/2, 440/40–43

See application file for complete search history.

(56) References Cited

U.S. PATENT DOCUMENTS 3,680,315 A * 8/1972 Aschauer et al. ..... 60/221
3,807,346 A * 4/1974 Delfeld ..... 440/41
4,474,561 A 10/1984 Haglund ..... 440/41
5,507,672 A * 4/1996 Imaeda ..... 440/1
6,071,156 A * 6/2000 Platzer et al. ..... 440/42

FOREIGN PATENT DOCUMENTS

SE 8102714-6 5/1982

OTHER PUBLICATIONS

Copy of International Search Report.
Copy of International Preliminary Examination Report.

* cited by examiner

*Primary Examiner*—Stephen Avila
(74) *Attorney, Agent, or Firm*—Michael Bednarek; Pillsbury Winthrop Shaw Pittman LLP

(57) ABSTRACT

The present invention relates to a steering arrangement for ships propelled by water jet, comprising a steering device (6) that is pivotal about an essentially vertical shaft (5) having a first center line (C1), at least one hydraulic cylinder (2; 3) for turning said steering device (6), which hydraulic cylinder is directly or indirectly articulately connected to the ship's body at one of its ends (2B; 3B), a turning device (4) connected to said shaft (5), for attachment to a second end (2A; 3A) of said hydraulic cylinder at a distance from said shaft (5), a reversing device (7) arranged in connection with said steering device (6) about an essentially horizontal shaft (12), an additional hydraulic cylinder (9) arranged to act on the reversing device (7), the additional hydraulic cylinder (9) following the movement of the steering device (6), characterized in that all the hydraulic cylinders (2,3,9) are arranged within a sheltered space (1) located above the extension of said vertical shaft (5), which space (1) is accessible for maintenance from the inside of the ship, and in that the arranging of said hydraulic cylinder (9) at the turning device (4) in relation to the steering device (6) is arranged such that the relative position of the reversing device (7) is uninfluenced by the relative position of the steering device (6).

8 Claims, 4 Drawing Sheets

STEERING ARRANGEMENT FOR A SHIP PROPELLED BY WATERJET

TECHNICAL FIELD

The present invention relates to a steering arrangement for ships propelled by water jet, comprising a steering device that is pivotal about an essentially vertical shaft having a first centre line, at least one hydraulic cylinder for turning said steering device, which hydraulic cylinder is directly or indirectly articulately connected to the ship's body at one of its ends, a turning device connected to said shaft, for attachment to a second end of said hydraulic cylinder at a distance from said shaft, a reversing device arranged in connection with said steering device about an essentially horizontal shaft, an additional hydraulic cylinder arranged to act on the reversing device, the additional hydraulic cylinder following the movement of the steering device.

STATE OF THE ART AND PROBLEM

Large water jet units have lately become more and more popular for driving bigger ships. Steering a ship with water jet is achieved according to a well-known principle by means of a box-shaped, pivoting steering device controlled by powerful hydraulic cylinder units, and a reversing device controlled by its own hydraulic cylinder and suspended in the steering device. However, the hydraulics is placed in the water, that is, outside the body. This involves a potential environmental hazard since the conduits with hydraulic oil for the cylinders might break and cause leakage of hydraulic oil into the water. It is a wish from some clients that this potential safety hazard is eliminated.

It is known to solve said problem by moving the hydraulic pistons inside the craft's transom frame and instead control the steering device and the reversing device suspended in the steering device by means of linked mechanisms, which are described in "Speed at Sea" in the June-number 2000. Because of the location of the reversing device these linked mechanisms are very long and cumbrous. Since movements are desired in both the vertical and the horizontal direction this solution also leads to several hinges, which may cause problems concerning both structural strength and accuracy of steering. A major disadvantage is that the relative position of the reversing device is influenced at steering, which means that complicated steering electronics are required to compensate for this influence.

An alternative solution to this problem is disclosed in U.S. Pat. No. 3,422,788, where it is chosen not to make the whole steering device pivoted but only a rudder-like element placed inside a kind of steering device, which is fixed. The reversing device is, in its part, suspended in the fixed steering device. Thus, the problem of the reversing device's influence is solved since the hydraulic piston that acts on the reversing device does not have to participate in any lateral movements. However, this solution involves many other considerable disadvantages, above all, an essentially deteriorated efficiency. Hence, it is not an acceptable solution.

Also through U.S. Pat. No. 3,807,346 a water jet is previously known where the steering- and reversing devices are controlled by hydraulics placed in a sheltered position. However, this solution shows that the reversing device moves laterally, not vertically, which is the conventional and desirable solution. Hence, this alternative construction is not desirable.

BRIEF DESCRIPTION OF THE INVENTION

It is an object of the present invention to find an optimal solution to the above-described complex of problems. This is achieved by a steering arrangement for ships propelled by water jet, comprising a steering device that is pivotal about an essentially vertical shaft having a first centre line, at least one hydraulic cylinder for turning said steering device, which hydraulic cylinder is directly or indirectly articulately connected to the ship's body at one of its ends, a turning device connected to said shaft, for attachment to a second end of said hydraulic cylinder at a distance from said shaft, a reversing device arranged in connection with said steering device about an essentially horizontal shaft, an additional hydraulic cylinder arranged to act on the reversing device, the additional hydraulic cylinder following the movement of the steering device, characterized in that all the hydraulic cylinders are arranged within a sheltered space located above the extension of said vertical shaft, which space is accessible for maintenance from the inside of the ship, and in that the arranging of said hydraulic cylinder at the turning device in relation to the steering device is arranged such that the relative position of the reversing device is uninfluenced by the relative position of the steering device.

Thanks to this solution it is possible to achieve a sheltered, but from the inside of the ship accessible, inclusion of hydraulic hoses and connections, and also a sheltered location of possible positional measuring equipment for automatic control of the steering, simultaneously avoiding cumbrous linkage mechanisms that influence the position of the reversing device.

According to further aspects of the invention:

- the hydraulic cylinder controlling the reversing device is articulately connected to a pivoting arm that in turn acts on a link that is connected to a lever arm for the reversing device,
- said centre line for said hydraulic cylinder comes close to, preferably cuts, said first centre line,
- said pivoting arm is arranged about a shaft the centre line of which comes close to, preferably cuts, said first centre line,
- said space has at least one wall that is part of the outer boundaries of the ship, said wall preferably being arranged above the water line,
- positional measuring equipment for measuring the position of the steering device and/or the reversing device is also arranged inside said space,
- the bottom part of said space is, at least partly, arranged above, in close connection to the outlet part for the water jet unit, and
- two cylinders are used for turning said steering device, which are articulately connected to the turning device with one of their ends at both sides of said shaft,

DESCRIPTION OF DRAWINGS

The invention will be explained more in detail with reference to the attached drawings, wherein.

DETAILED DESCRIPTION OF THE INVENTION

Figure 1:
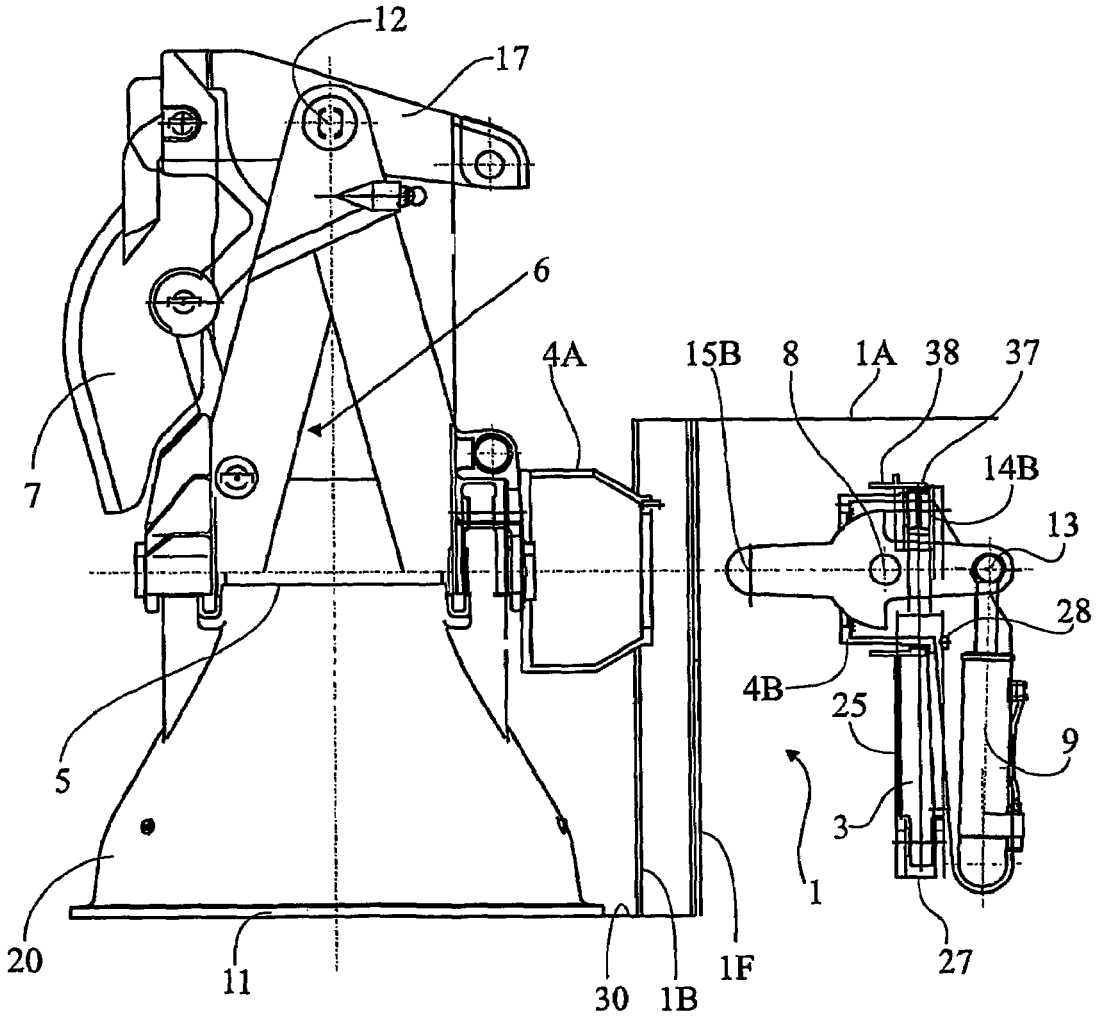
FIG. 1 shows a preferred steering arrangement according to the invention as a side view, partly in cross-section.
Figure 2:
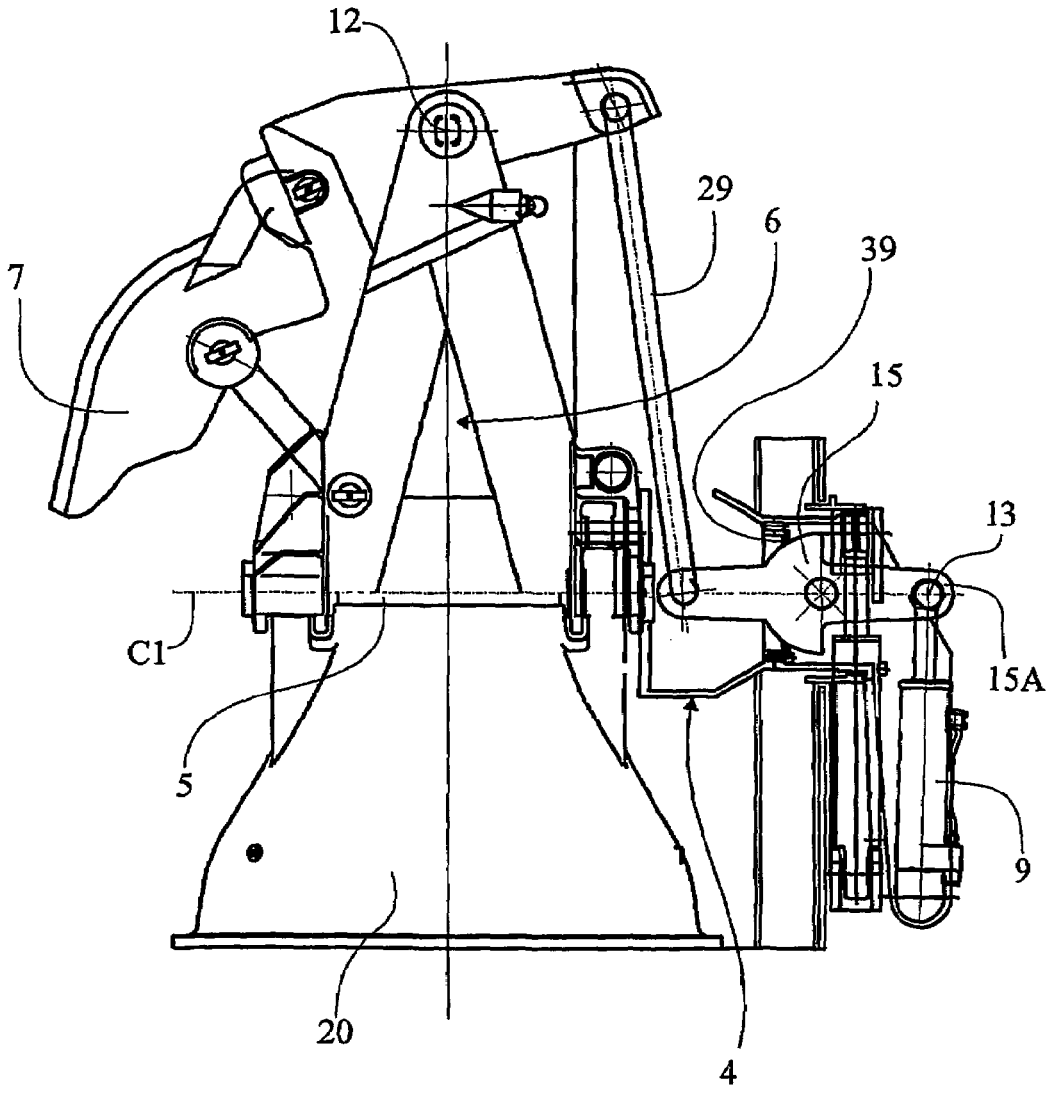
FIG. 2 shows the same view as FIG. 1 but with the reversing device in another position.

In FIGS. 1 and 2 there is shown in a side view two different positions for an arrangement according to the invention. The basic design of the steering arrangement is made in a conventional way. Thus, a steering arrangement known in itself is disclosed that comprises a steering device 6 that is pivotal about a vertical shaft 5, which is fixed in the water jet's outlet part 20 which in its turn is attached to the ship's transom 30. Furthermore, this basic construction consists of a beam arrangement fixed at each side of the steering device and in which there is arranged a hinge 12 for suspension of a lever arm 17 of a reversing device 7.

In FIG. 1 the reversing device is shown in its inactivated mode, that is, a position for full speed ahead. At the same time, some parts of the steering system are shown at a distance from the mounting position, for sake of lucidness.

In FIG. 2 the reversing device is shown in an activated mode, with the steering system in the mounting position, where the jet stream thus is diverted for the achievement of a reversing force.

The novel feature of this design is the arrangement of the hydraulic cylinders 2, 3, 9 and belonging mechanisms that act on steering device 6, and reversing device 7 respectively. The cylinders 2, 3, 9 are arranged within a closed space 1 above the actual basic construction. The space is delimited astern by a plate 1A, that in the preferred embodiment extends essentially vertically in a plane abaft the vertical shaft 5. At the bottom, the space is delimited by a plate 1B that is essentially horizontal and attached to a transom stern 30, immediately above the jet unit's attachment flange 11. The space 1 holds two cylinders 2, 3 for the turning mechanism and a cylinder 9 for the reversing device 7. In the turning mechanism there is included a turning device 4A, 4B that is fixed to and pivotal with the vertical shaft 5. An upper half 4B of said turning device comprises a cylindrical part that, by bearings 37 (diagrammatically shown), is arranged to be pivotal inside a cylindrical bearing seat 38, which in its turn is fixed to a beam framework 25, 26, 27. At the upper half 4B, two axis journals 14A, 14B are arranged (se FIG. 3), at which the front end 3A, 2A of the corresponding hydraulic cylinder 2, 3 is articulately arranged for turning of the turning device 4 and thereby also of the steering device 6.

Figure 4:
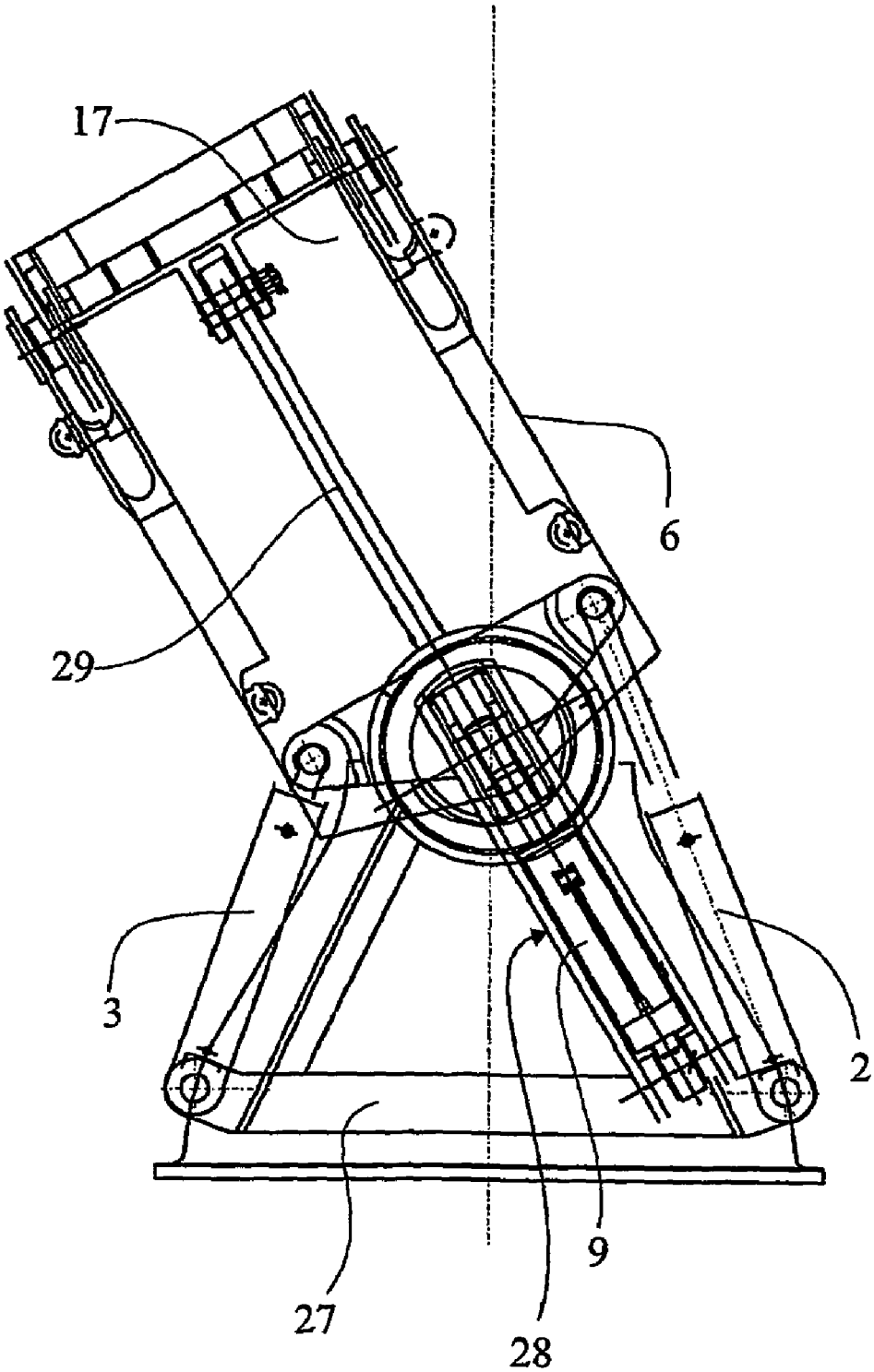
FIG. 4 shows the same view as FIG. 3 but with the steering device in another position.

Furthermore, a pivoting arm 15 is arranged at said upper half 4B of the turning device 4, which pivoting arm is pivotally arranged about an essentially horizontal axis 8, that is fixed in and follows the turning movement of the upper half 4B. The lower part 15B of the pivoting arm is connected to an inner end of a link 29, the outer end of which being articulately connected to the lever arm 17 for the reversing device 7. The other end 15A of the pivoting arm is articulately connected to the hydraulic cylinder 9, by an articulating shaft 13. In its other end 9B, this hydraulic cylinder 9 is articulately arranged at a shaft 9C. The shaft 9C is arranged between two anchor bars 28A, 28B. The anchor bars 28 are anchored to the upper half 4B of the turning device 4. Accordingly, the hydraulic cylinder 9 of the reversing device 7 is arranged above the turning device 4, so that is turns together with that in its movement. The centre line C2 of the shaft 8 for the pivoting arm 15 is arranged to cut the centre line C1 of the vertical shaft 5. Also the centre line C3 for the hydraulic cylinder 9 (see FIG. 4), is arranged to cut the centre line C1 of the vertical shaft 5. This suspension means that the relative position of the reversing device 7 in relation to the pivoting arm 15, is uninfluenced by the relative position of the steering device 6. Accordingly, the reversing device 7 will not change its relative position in relation to the pivoting arm 15 even if the steering device 6 is turned to different positions, which otherwise could be the case in accordance with prior art designs that make use of linkage mechanisms. The turning hydraulic cylinders 2, 3 are, at their respective rear ends, articulately connected about an axis journal 2B and 3B, respectively, that is arranged at the transversal beam element 27, that in its turn is firmly anchored to the framework beams 25, 26 that are fixed to the bearing seat 3B.

In the drawings, there is shown a possible embodiment for the sealing of the upper space 1, by the arrangement of a seal 39 that seals between the pivoting arm 15 and the space inside the upper half 4B of the turning device 4. However, it should be pointed out that sealing may take place in many different ways (e.g. by a sealing bellows being arranged around the link 29 in the open space in the lower part 4A of the turning device), and that sealing in certain cases is not necessary at all, if the space 1 is located high enough above the water line.

Inside said space 1, a manifold chamber (not shown) for hydraulic oil is arranged, from which chamber exits hydraulic hoses (not shown) for supply and withdrawal of hydraulic oil to the hydraulic cylinders. Due to this arrangement, both manifold chamber and hydraulic hoses will be placed in a sheltered position within said space 1.

Figure 3:
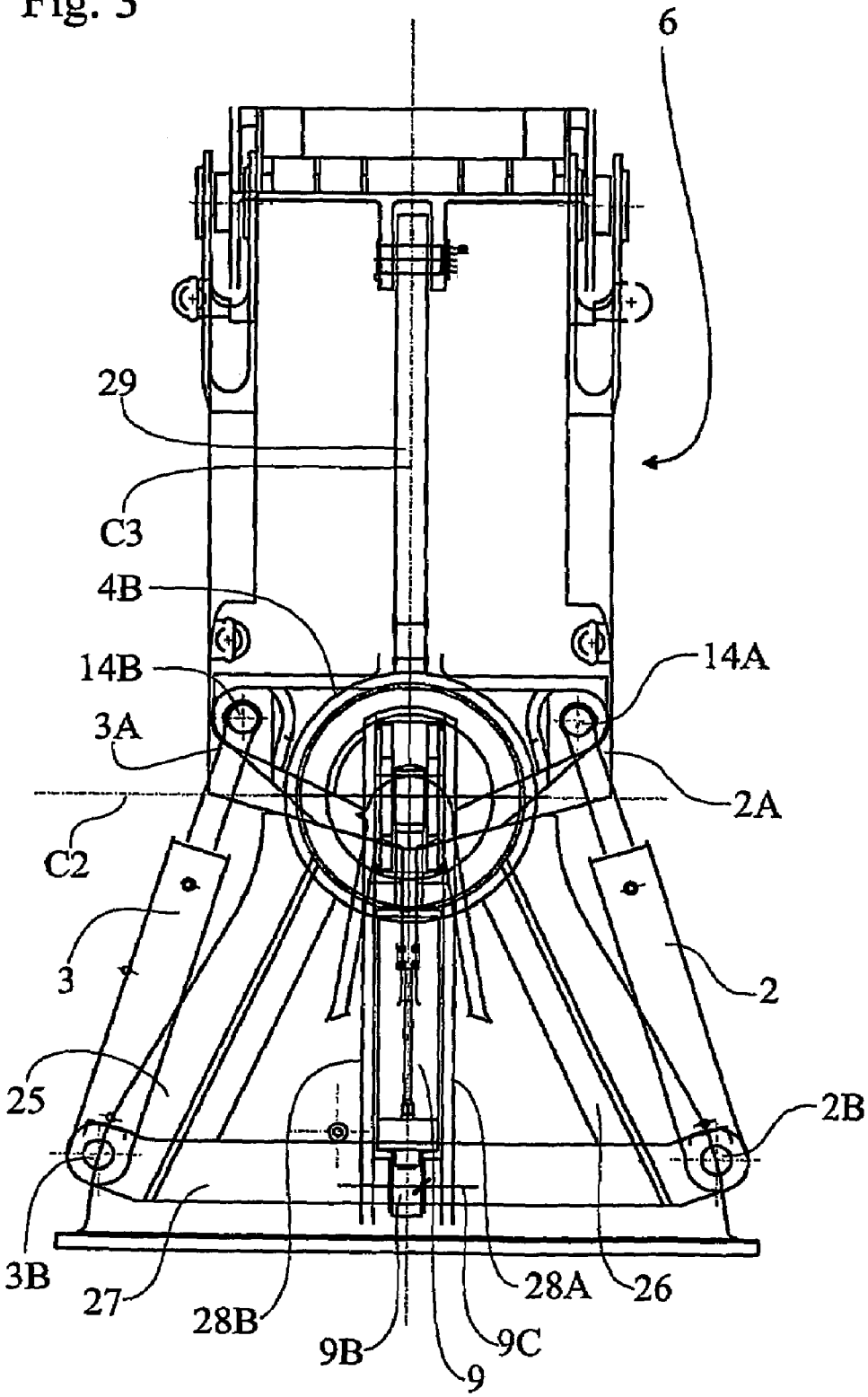
FIG. 3 shows the steering arrangement according to FIG. 1 seen from above, partly in cross-section.

In FIG. 3, the steering arrangement according to the preferred embodiment is shown as seen from above. It shows the steering device 6 is shown in a folded position, i.e. for driving straight ahead when the reversing device 7 is inactivated. The position in FIG. 3 is achieved by means of the hydraulic cylinders 2, 3 being positioned by each end 2A, 3A of the piston rods, in a common plane which is parallel with the jet unit's attachment flange 11. From this position, by pushing out the piston rod of the port hydraulic cylinder 3 and at the same time pulling in the piston rod of the starboard hydraulic cylinder 2, the turning device 4 is turned about the vertical shaft 5, so that the steering device 6 is angled relative to the jet unit's attachment flange 11, which leads to a yaw.

Owing to the invention a sheltered location of the hydraulics is achieved without having to use cumbrous linkage mechanisms.

The invention is not limited to what has been described above but may be varied within the scope of the claims. Thus, it is realized that it is not necessary to have two hydraulic cylinders to act on the turning device but that in certain cases it is quite adequate only to have one hydraulic cylinder. However, two symmetrically placed hydraulic cylinders for the turning is preferable, not at least for reliability-/safety reasons. Furthermore, it is realized that the principle also may be used, by means of linkage mechanisms, to connect in parallel several adjacently arranged steering arrangements.

The invention claimed is:

1. Steering arrangement for ships propelled by water jet, comprising:

a) a steering device (6) that is pivotal in relation to the ship's body about an essentially vertical center line (Cl);

b) a turning device (4) fixedly connected to said steering device;

c) at least one hydraulic cylinder (2; 3) for turning said steering device (6) via said turning device;

d) a reversing device arranged in connection with said steering device (6); and e) an additional hydraulic cylinder (9) arranged to act on the reversing device (7), wherein said at least one hydraulic cylinder is directly or indirectly articulately connected to the ships' body at one end of its ends (2B; 3B) and connected to said turning device at a second end (2A; 3A) at a distance from said center line, wherein all hydraulic cylinders (2, 3, 9) are arranged within a sheltered space (1) located above the extension of said center line, which space (1) is accessible for maintenance from the inside of the ship, wherein said reversing device is arranged about an essentially horizontal shaft (12) on said steering device to follow the movement of the steering device (6), wherein said additional hydraulic cylinder (9) is arranged at the turning device (4) such that the relative position of the reversing device (7) is uninfluenced by the relative position of the steering device (6), and wherein movement of said additional hydraulic cylinder produces a horizontal pivotal movement of said reversing device.

2. Steering arrangement according to claim 1, characterised in that the hydraulic cylinder (9) controlling the reversing device (7) is articulately connected to a pivoting arm (15) that in its turn acts on a link (29) that is connected to a lever arm (17) for the reversing device (7).

3. Steering arrangement according to claim 2, characterised in that said centre line (C3) of said hydraulic cylinder (9) comes close to said first center line (Cl).

4. Steering arrangement according to claim 2, characterised in that said pivoting arm (15) is arranged about a shaft (8), the center line (C2) of which comes close to said first center line (C1).

5. Steering arrangement according to claim 1, characterised in that said space (1) has at least one wall (1A) that is part of the outer boundaries of the ship, said wall being arranged above the water line.

6. Steering arrangement according to claim 1, characterised in that positional measuring equipment for measuring the position of the steering device (6) and/or the reversing device (7) also is arranged within said space.

7. Steering arrangement according to claim 1, characterised in that said bottom part (1F) of said space (1) at least for some part is arranged above and in contact with, the outlet part (20) for the water jet unit.

8. Steering arrangement according to claim 1, characterised in that two cylinders (2, 3) articulately connected to said turning device (4) and with their first ends (2A; 3A) on each side of said shaft (5), are used to turn the steering device (6).

* * * * *